US005183345A

United States Patent [19]

Suzuki

[11] Patent Number: 5,183,345

[45] Date of Patent: Feb. 2, 1993

[54] TWO-COLOR SHIFTING DEVICE FOR PRINTING RIBBON

[75] Inventor: Masato Suzuki, Yokohama, Japan

[73] Assignee: Amano Corporation, Japan

[21] Appl. No.: 904,695

[22] Filed: Jun. 26, 1992

[30] Foreign Application Priority Data

Jun. 27, 1991 [JP] Japan ..... 3-057683

[51] Int. Cl.[5] ..... B41J 33/54

[52] U.S. Cl. ..... 400/211; 400/213; 400/695; 400/212

[58] Field of Search ..... 400/217, 208, 223, 227, 400/695, 697.1, 211, 213, 213.1, 229, 215, 216.1, 216.2

[56] References Cited

U.S. PATENT DOCUMENTS

| | | | |
|---|---|---|---|
| 4,244,290 | 1/1981 | Tamai et al. | 400/212 |
| 4,353,657 | 10/1982 | Schaefer | 400/208 |
| 4,460,287 | 7/1984 | Theilen et al. | 400/213.1 |
| 4,472,073 | 9/1984 | Valle et al. | 400/212 |
| 4,538,931 | 9/1985 | Nagashima | 400/212 |
| 4,573,813 | 3/1986 | Aoui et al. | 400/216.1 |
| 4,697,942 | 10/1987 | Yagi et al. | 400/208 |
| 4,840,505 | 6/1989 | Kurokawa | 400/697.1 |
| 4,884,907 | 12/1989 | Yasumi | 400/216.1 |
| 4,981,376 | 1/1991 | Oku | 400/223 |
| 5,087,136 | 2/1992 | Nakajima | 400/697.1 |

FOREIGN PATENT DOCUMENTS

| | | |
|---|---|---|
| 333901 | 3/1986 | Japan . |
| 56-172166 | | |
| 59-19357 | 2/1984 | Japan . |

*Primary Examiner*—Eugene H. Eickholt

*Attorney, Agent, or Firm*—Stevens, Davis, Miller & Mosher

[57] ABSTRACT

A feed wheel 10 provided at front and rear sides thereof with an intermittent gear 10*b* and a notched gear 10*d*, is formed on one end portion of a cylindrical cam shaft 5 for moving a printer, with a mesh-prevention side 10*c* left at its center. A switch cam 11 for moving a ribbon cassette upwardly and downwardly is integrally formed on one end portion of a guide shaft 4 of the printer. A notched pinion 9 having a feed gear 9*a* and an intermittent feed gear 9*b* arranged alternately on its peripherals surface is also slidably mounted on the end portion of the guide shaft 4. When the printer is moved to a two-color shifting position in accordance with a program, the printer pushes the notched pinion 9 for movement against a compression spring 8, so that the intermittent feed gear 9*b* and the feed gear 9*a* of the notched pinion 9 is brought into mesh with the intermittent gear 10*b* and the notched gear 10*d* of the feed wheel 10, respectively, to rotate the notched pinion 9 in order to pivot a switch cam 11.

1 Claim, 6 Drawing Sheets

TWO-COLOR SHIFTING DEVICE FOR PRINTING RIBBON

BACKGROUND OF THE INVENTION

1. Field of the Invention

This invention relates to a two-color shifting device for a printing ribbon, utilized in a technical field of a printing device for printing various kinds of data using a printer as in, for example, a time recorder. More specifically, it relates to a two-color shifting device for a shifting device for a printing ribbon which is suitably used in various printing devices such as a time recorder.

2. Brief Description of the Prior Art

As for conventional two-color shifting devices for a printing ribbon, in which the printing color can be switched between a normal color positon such as a black color or a blue color and an abnormal color position such as a red color by switching or shifting a ribbon cassette containing a printing ribbon upwardly and downwardly relative to a printer, there are known two types. One is of the type, as disclosed, for example, in Japanese Early Laid-Open Utility Model Publication No. Sho 59-19357, in that two-color shift is made by switching or shifting the ribbon cassette upwardly and downwardly using a mechanical device. The other is of the type, as disclosed, for example, in Japanese Early Laid-Open Utility Model Publication No. Sho 56-172166, in that two-color shifting is made by moving the ribbon cassette upwardly and downwardly using a solenoid for exclusive use. At present, the two-color shifting device using a solenoid occupies a main stream because of its reliable operation.

However, the conventional two-color shifting device using a solenoid has the following problems. Since the ribbon cassette, a shifting mechanism for shifting this cassette upwardly and downwardly, and the solenoid for actuating this shifting mechanism, are required to be arranged in a vertical row, a whole device is obliged to become large, and a large mounting space is required. Moreover, since the construction of the whole device is complicated, its assembly and maintenance are troublesome, and costs thereof are high.

In view of the above, the present applicant has proposed and successfully developed a two-color shifting device for a printing ribbon, as discussed in a Japanese Utility Model application No. Hei 3-33901 which was previously filed by the present applicant, in which two-color shifting of a printing ribbon can be effected correctly using a very simple device and without using a solenoid.

The above two-color shifting device for a printing ribbon comprises a notched pinion provided with a feed gear and an intermittent gear arranged alternately in the circumferential direction, the notched pinion being slidably mounted on a guide shaft, when this notched pinion is pushed into a two-color shifting position against a compression spring by a printer which is moved in accordance with rotation of a cylindrical cam shaft, a two-piece gear mounted on a feed wheel being brought into mesh with a feed gear and an intermittent feed gear of the notched pinion, respectively, this feed wheel being rotated by a motor to cause the notched pinion to make a feed-rotation, so that a switch cam integral with the notched pinion is shifted upwardly or downwardly, thereby effecting two-color shifting of its printing color to be printed on a card.

However, the two-color shifting device for a printing ribbon thus constructed also has the following problems. In the case where the feed wheel is stopped rotation due to, for example, an electric power failure, with the two-piece gear contacting the feed gear of the notched pinion, the feed gear is readily meshed with the two-piece gear when vibration and/or impact is applied thereto. If the feed wheel starts rotation in the foregoing state because of recovery of electric power supply, the notched pinion is caused to make a feed-rotation by the two-piece gear to shift the ribbon cassette upwardly or downwardly. As a result, two-color shifting is accidentally effected at a timing when it should not be effected. The result is that an undesired color printing is made on a card by the wrong or failure ribbon shifting.

SUMMARY OF THE INVENTION

It is therefore an object of the present invention to provide a two-color shifting device for a printing ribbon, in which two-color shifting of a printing ribbon is effected correctly without inviting a wrong color shifting under any timing, using a simple device and without using a solenoid.

To achieve the above object, according to the present invention, there is provided a two-color shifting device for a printing ribbon, in which when a notched pinion provided with feed gear and intermittent feed gear formed alternately thereon in a circumferential direction thereof is pushed by a printer in order to be moved to a two-color shifting position against a compression spring, a two-piece gear formed on a feed wheel to be rotated by a motor is brought into mesh with the feed gear and intermittent feed gear in turn, respectively, to cause the notched pinion to make a feed-rotation, so that a switch cam formed on the notched pinion switches a ribbon cassette between an upper position and a lower position to effect a two-color shifting, wherein the two-color shifting device for a printing ribbon is characterized by:

(1) the feed gear and intermittent gear axially spacedly arranged alternately on the peripheral surface of the notched pinion, a two-piece gear formed of a notched gear meshable with the feed gear and an intermittent gear meshable with the intermittent notched gear, being arranged on both front and rear sides of the peripheral surface of the feed wheel, with a mesh-prevention side thinner than a distance between the feed gear and the intermittent feed gear being left at a center thereof, and (2) when a normal printing is effected, the feed gear being in contact with the mesh-prevention side to prevent the feed gear from meshing with the notched gear, however, when the notched pinion is moved to the two-color shifting position, the feed gear and intermittent feed gear being brought into mesh with the notched gear and intermittent gear, respectively, so thatg the notched pinion makes a feed-rotation.

By virtue of the above feature (1), the distance between the feed gear and the intermittent feed gear formed on the peripheral surface of the notched pinion is formed wider than the width of the mesh-prevention side of the feed wheel, and therefore when this mesh-prevention side is located within the range of the above distance, both the feed gear and intermittent feed gear are meshed with the two-piece gear formed of a notched gear and an intermittent gear formed on both front and rear sides of the mesh-prevention side in order to cause the notched pinion to be shifted in accordance with rotation of the feed wheel, thereby effecting two-color shifting of the ribbon cassette by the switch cam.

By virtue of the above feature (2), when a normal color printing is effected (where two-color shifting is not effected), the mesh-prevention side is in a position able to contact the feed gear of the notched pinion, and therefore this mesh-prevention side serves to prevent the feed gear and the intermittent feed gear from meshing with the notched gear and the intermittent gear of the feed wheel. As a result, there can be prevented such a wrong ribbon shifting as that two-color shifting is effected at a timing when it should not be effected. When the notched pinion is moved to the two-color shifting position, the feed gear and the intermittent gear of the notched pinion are meshed with the two-piece gear formed of the notched gear and the intermittent gear of the feed wheel, respectively. Therefore, the notched pinion is surely shifted so that two-color shifting of the printing ribbon is effected without fail.

DETAILED DESCRIPTION OF THE EMBODIMENT

One preferred embodiment of a two-color shifting device for a printing ribbon according to the present invention will now be described with reference to the accompanying drawings.

Figure 1:
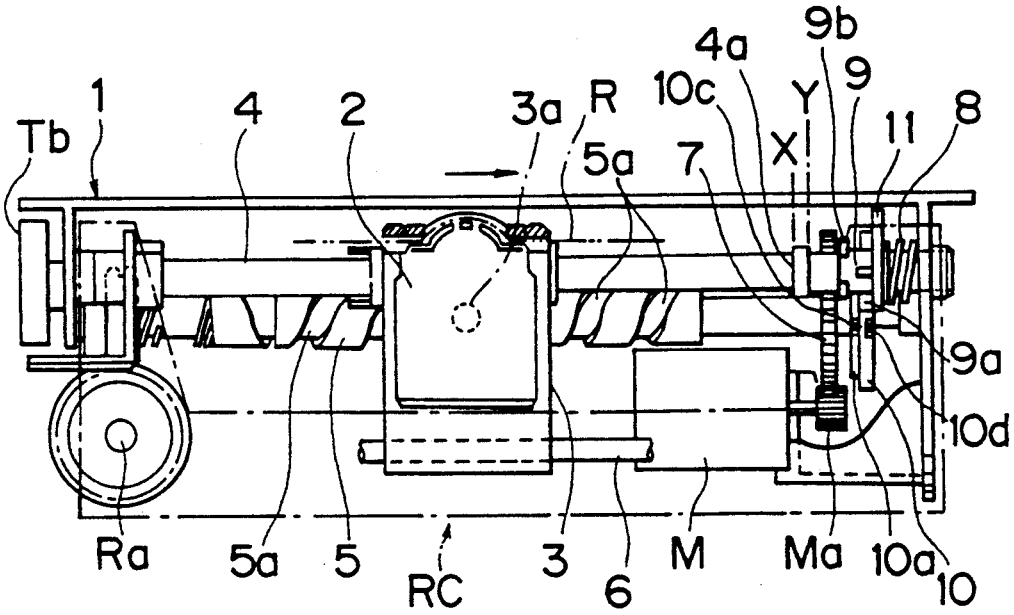
FIG. 1 is a plan view of a printer provided with a two-color shifting device for a printing ribbon according to the present invention.

FIG. 1 is a plan view of a printer including a two-color shifting device for a printing ribbon according to the present invention. In this Figure, the numeral 1 denotes a frame of the printer, 2, a printer mounted on a printer mount or carrier 3, and 4 and 6, two primary and secondary guide shafts disposed at the frame 1 in parallel relation, respectively. The printer carrier 3 is movably mounted on the guide shafts 4 and 6. The numeral 5 denotes a cylindrical cam shaft which is disposed likewise at the frame 1 in parallel relation with the guide shafts 4 and 6. A guide knob 3*a* projecting from a bottom surface of the printer carrier 3 is in engagement with a guide groove 5*a* formed spirally in a peripheral surface of this cam shaft 5. The arrangement being such that, upon rotation of the cylindrical cam shaft 5, the printer carrier 3 is larelally moved along the guide shafts 4 and 6 in order to move laterally the printer 2 which is now at printing operation. The numeral 7 denotes a rotary gear mounted on one end portion of the cylindrical cam shaft 5, and this gear 7 is meshed with a driving gear Ma in order to rotate the rotary cylindrical cam shaft 5.

The symbolic characters RC denote a ribbon cassette which is vertically movably mounted on the frame 1, and Ra denotes a feed shaft for the printing ribbon R. In the embodiment illustrated, the printing ribbon R looped around a head of the printer 2 is fed in the left-hand side direction in FIG. 1 in accordance with rotation of this feed shaft Ra. Since the ribbon cassette RC, the feed mechanism of the printing ribbon R, etc. are known as disclosed, for example, in Japanese Early Laid-Open Utility Model Publication No. Sho 56-172166, detailed description thereof is omitted.

Figure 9:
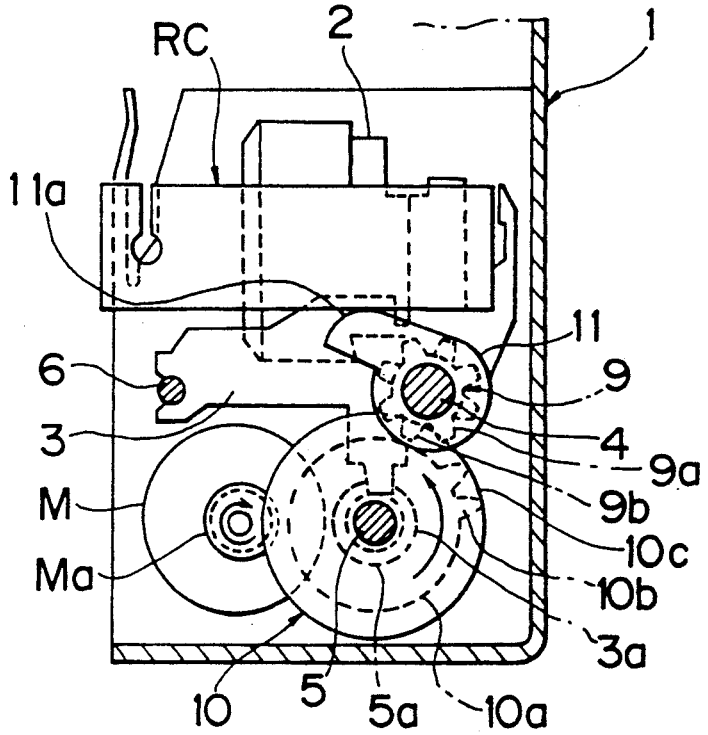
FIG. 9 is a front sectional view showing the constitution of the important portion of the present invention when the printer is in a normal color printing condition.
Figure 11:
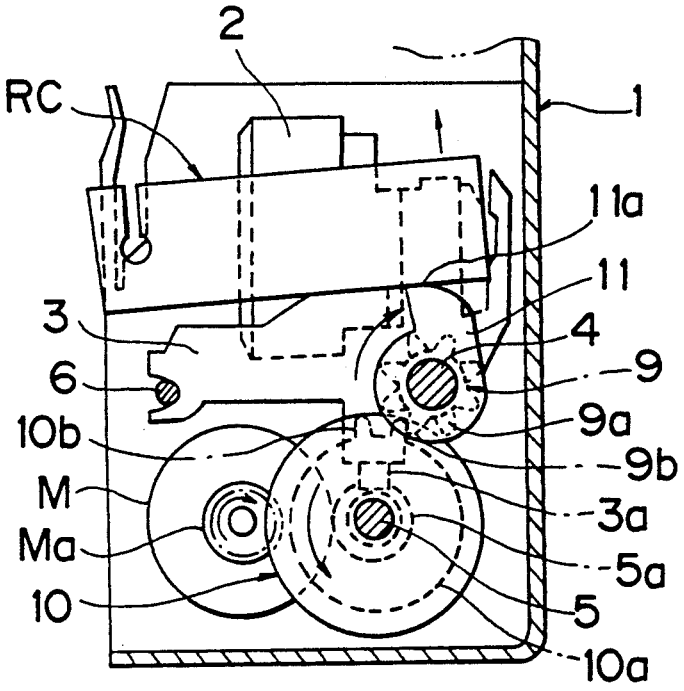
FIG. 11 is a front sectional view showing the important portion of the present invention when the printer is in the two-color shifting condition.
Figure 12:
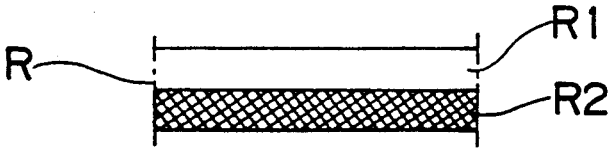
FIG. 12 is a schematic view showing a general constitution of a printing ribbon.

FIG. 12 denotes a schematic view showing a general construction of the printing ribbon R. The printing ribbon R comprises an upper-half normal color portion R1 such as black color or blue color, and a lower-half abnormal color portion R2 such as red color, etc. As shown in FIG. 9, when the ribbon cassette RC is in its horizontal position (facing downward), the upper-half normal color R1 portion is positioned at the head of printer 2 to effect a normal color printing. On the other hand, as shown in FIG. 11, when the ribbon cassette RC is shifted into a position facing upward, the lower-half abnormal color portion is positioned at the head of the printer 2 to effect an abnormal color printing.

In the Figure, the symbolic numeral 4*a* denotes a collar axially slidably engaged with one end portion of the primary guide shaft 4. When in normal color printing, the printer 2 movable in accordance with rotation of the motor M, is programmed such that the printer 2 stops its lateral movement (while printing) in a position indicated by the X-line of FIG. 1, in other words, position where the collar 4*a* is not pushed for movement by the printer 2. On the other hand, when in abnormal color printing (which is preprogrammed), the motor M moves the printer 2 up to a position (i.e., two-color shifting position) indicated by a Y-line of FIG. 1. As a result, the collar 4*a* is caused to move rightward in FIG. 1 to that extent.

Figure 2:
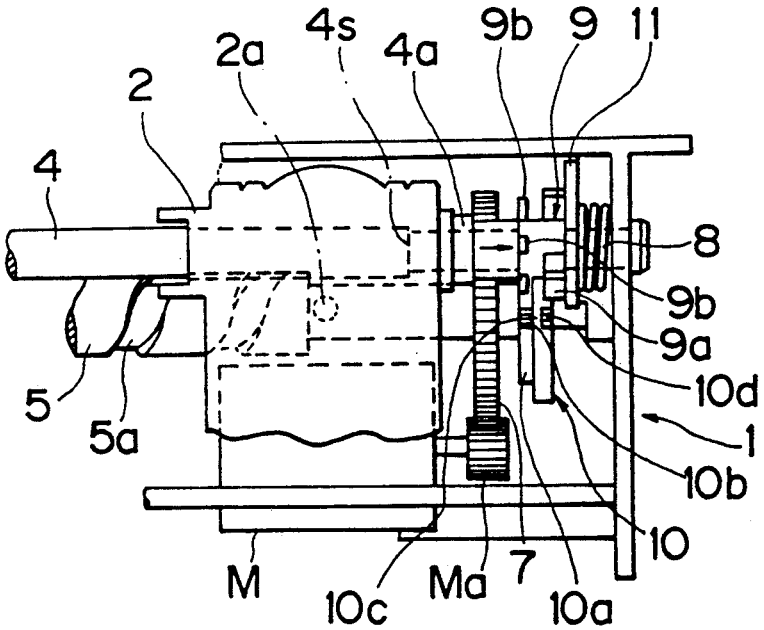
FIG. 2 is an enlarged plan view of an important portion of the above, in which the printer is now in a two-color shifting condition.
Figure 3:
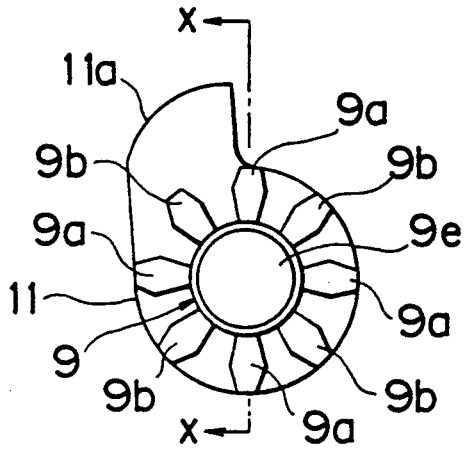
FIG. 3 is a front view of a notched pinion which is to be used in the present invention.
Figure 4:
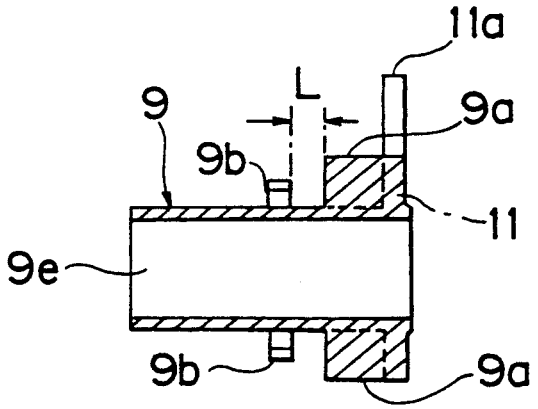
FIG. 4 is a sectional view of the notched pinion taken along the line X—X of FIG. 3.
Figure 5:
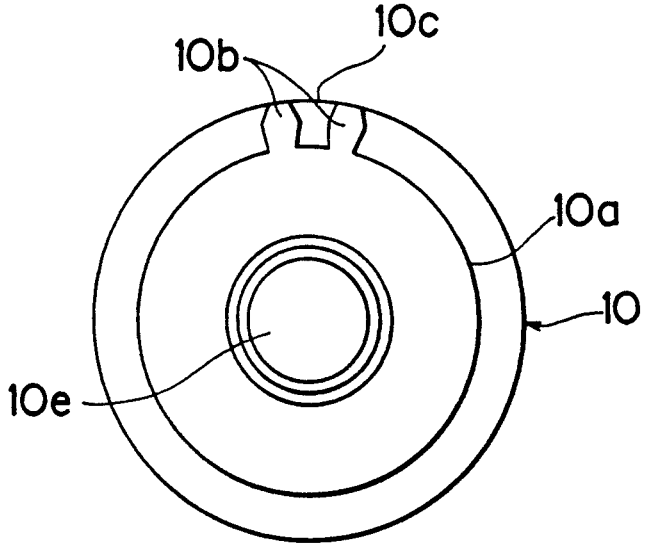
FIG. 5 is a front view of a feed wheel which is to be used in the present invention.

FIG. 1, the reference characters Tb denote a timing plate for controlling rotation of the cylindrical cam shaft 5. In FIG. 2, 4*s* denotes a step portion which is adapted to retain the sliding of the collar 4*a* slidably mounted, side by side with respect to the collar 4*a*, on one end portion of the primary guide shaft 4. On a peripheral surface of this notched pinion 9, four wide feed gears 9*a* and four narrow intermittent feed gears 9*b* having a width less than a half of that of the feed gears 9*a*, as shown in FIGS. 3 and 4, are arranged alternately, and axially (lateral direction) spacedly at spaces L as shown in FIG. 4. On the other side surface of this notched pinion 9, a switch cam 11 for switching the ribbon cassette RC between an upper and a lower positions, is integrally formed.

In the Figures, 11*a* denotes an apex or top of this switch cam 11. The switch cam 11 is operated to push the ribbon cassette RC upwards by this top 11*a* portion, as shown in FIG. 11, so that a lower half (i.e., abnormal color R2 portion) of the printing ribbon R is set to the printer head. Also, the switch cam 11 is operated to lower the ribbon cassette RC to a horizontal position, as shwon in FIG. 9, by its remaining cam face, so that an upper half (i.e., normal color R1 portion) of the printing ribbon R is set ti the printer head.

The numeral 8 denotes a compression spring mounted on one end of the primary guide shaft 4. The compression spring 8, which is interposed in its compressed state between an outer surface of the switch cam 11 and an inner surface of the frame 1, has such a biasing force as to restore the notched pinion 9 including the switch cam 11, and the collar 4*a* normally to their original positions (that is, normal position of FIGS. 1 and 8 where the collar 4*a* is retained by the step portion 4*s* shown in FIG. 2).

Figure 6:
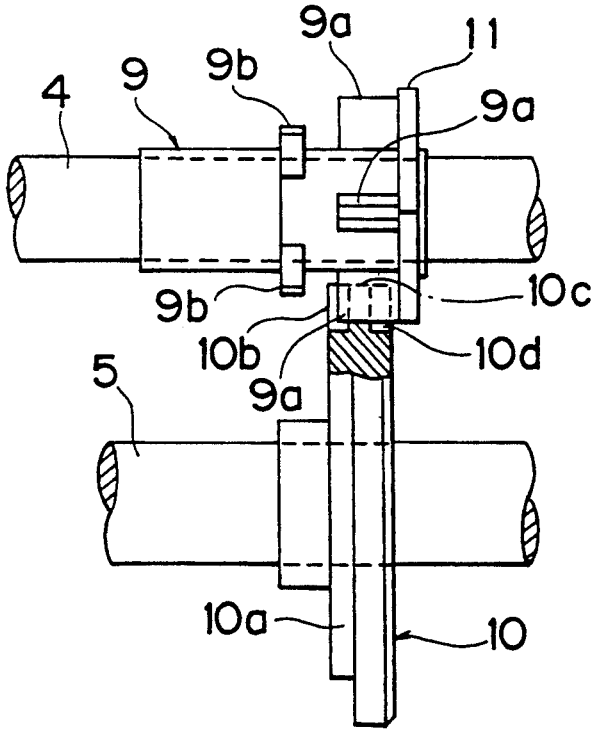
FIG. 6 is a partly sectional side view showing a relation between the notched pinion and the feed wheel when the printer is in a normal color printing condition.
Figure 7:
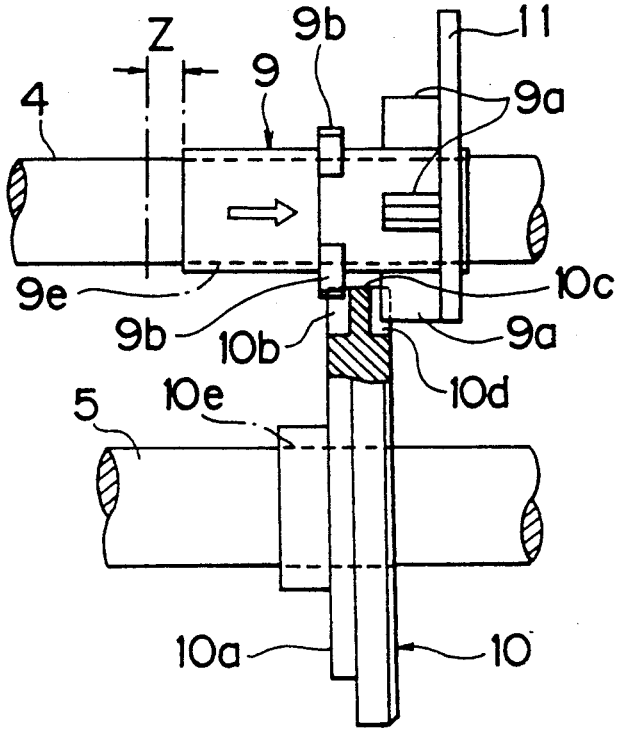
FIG. 7 is a partly sectional side view showing a relation between the notched pinion and the feed wheel when the printer is in the two-color shifting condition.
Figure 10:
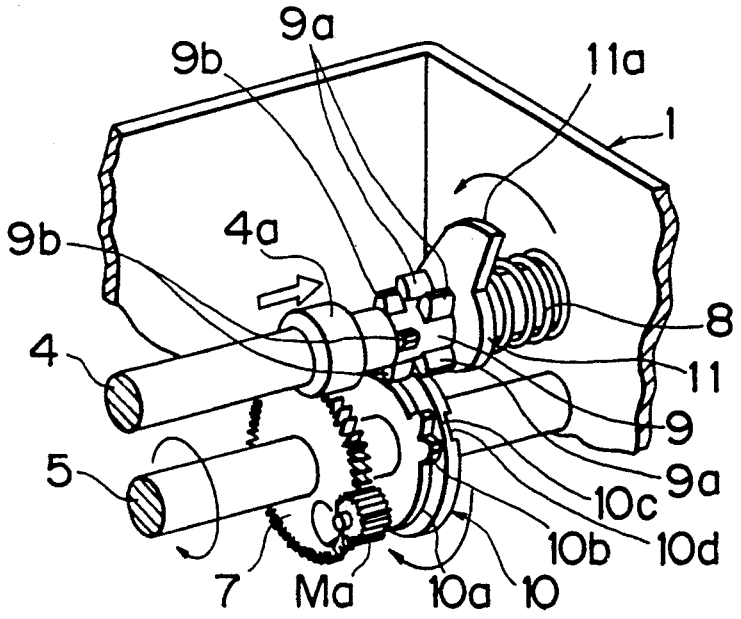
FIG. 10 is a perspective view showing the important portion of the present invention when the printer is in the two-color shifting condition.

The numeral 10 denotes a feed wheel mounted on one end of the cylindrical cam shaft 5. As shown in FIGS. 6 and 7, a side 10*c* having a narrower width than the distance or space L between the adjacent feed gear 9*a* and the intermittent feed gear 9*b* of the notched pinion 9 and adapted to prevent their meshing is formed on a part of the peripheral surface of the feed wheel 10. Furthermore, a two-piece gear formed of a notched gear 10*d* and an intermittent gear 10*b* respectively meshable with the feed gear 9*a* and the intermittent feed gear 9*b* of the notched pinion 9, is formed on both front and rear sides of the mesh-prevention side 10*c*. Normally, a peripheral surface including the mesh-prevention side 10*c* of this feed wheel 10 is in contact with a peripheral surface portion of the notched pinion 9 provided with the feed gear 9*a*, as shown in FIG. 9. Therefore, the notched pinion 9 is also in contact with the peripheral surface of the feed wheel 10 at its three points, i.e., peripheral surface, and front and rear feed gears 9*a* and 9*b*, so that the notched pinion 9 does not make a feed-rotation by either of the gear elements of the two-piece gear formed of the front and rear notched gear 10*d* and intermittent gear 10*b*. As a result, the switch cam 11 can be held in a position where the ribbon cassette RC faces downward as shown in FIG. 9, or in a position where the ribbon cassette RC faces upward as shown in FIG. 11. However, when the notched pinion 9 is pushed for movement rightward to a position as shown in FIG. 1 or FIG. 10 upon movement of the printer 2 to the two-color shifting position (Y-line position), the intermittent feed gear 9*b* is meshed with the intermittent gear 10*b* as shown in FIG. 7. As a result, since the feed gear 9*a* is escaped from the mesh-prevention side 10*c* to mesh with the notched gear 10*d*, the notched pinion 9 is operatively connected to the feed wheel 10 so as to make a feed-rotation. As a result, the switch cam 11 switches the ribbon cassette RC between the upper and lower positions.

In the illustrated embodiment, it is designed such that when the cylindrical cam shaft 5 makes four rotations caused by ¼ peripheral intermittent rotation during one rotation of the cylindrical cam shaft 5 (feed wheel 10), the switch cam 11 makes one rotation. However, it should be understood that these ratios of rotation are shown merely as one example. In FIGS. 6 and 7, the peripheral surface of the feed wheel 10 is illustrated in such a manner as to be spaced apart from the peripheral surface of the notched pinion 9, but this is only for the sake of convenience for clarifying the meshing relation of the gears, and they are actually lightly contacted with each other. In FIG. 7, the reference character Z denotes a distance of movement carried out by the notched pinion 9. In the various FIGS., 10*a* denotes a disc portion of the feed wheel 10 having the intermittent gear 10*b* projecting from its peripheral surface.

Since a two-color shifting device for a printing ribbon according to the present invention has the above-mentioned constitution, a normal color printing is effected under the conditions that the ribbon cassette RC is in its lower position as shown in FIG. 9, and the movement of the printer 2 caused by the motor M is stopped at the X-line position of FIG. 1. When it becomes the time for shifting the printing color to an abnormal color mode (for example, red color), the motor M causes the printer 2 to move up to the two-color shifting position as indicated by the Y-line of FIG. 1 in accordance with a program, and as a result, the collar 4*a* and the notched pinion 9 are pushed for movement rightward against the compression spring 8 as shown in FIGS. 2 and 1.

As a result, the feed gear 9*a* of the notched pinion 9, which is in a position able to contact the mesh-prevention side 10*c* as shown in FIG. 6, is meshed with the notched gear 10*d* of the feed wheel 10 as shown in FIG. 7, and the intermittent feed gear 9*b* is also moved to a position able to mesh with the intermittent gear 10*b*. Therefore, when the cylindrical cam shaft 5 is continuously rotated by the motor M in the foregoing state, the notched pinion 9 is intermittently fed by the two-piece gear 10*b* and 10*d* to rotate the switch cam 11 in the direction as indicated by an arrow of FIG. 10, and the ribbon cassette RC is pushed up by the top 11*a* of the switch cam 11 as shown in FIG. 11, thereby enabling to effect an abnormal color printing of the abnormal color ribbon 2.

Figure 8:
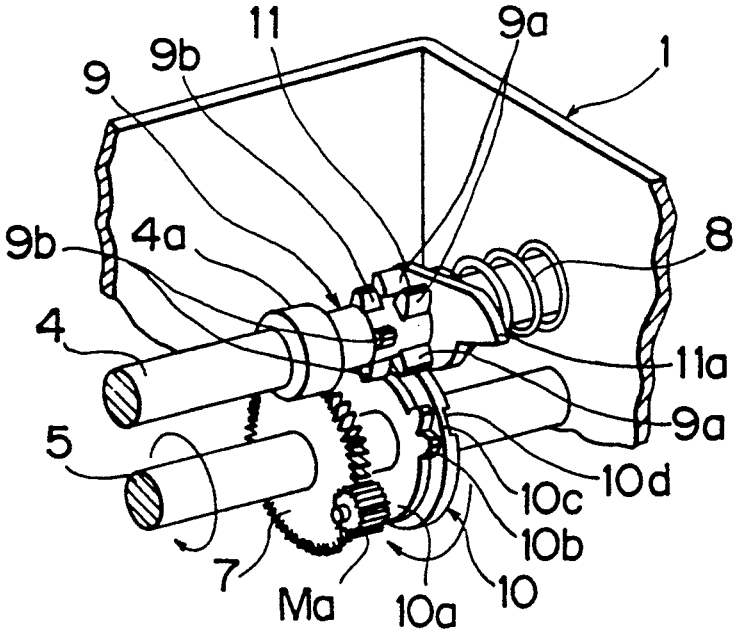
FIG. 8 is a perspective view showing a constitution of an important portion of the present invention.

In this way, when the ribbon cassette RC is pushed up to shift the color of the ribbon to the abnormal color printing condition, the printer 2 is moved laterally by the motor M to remove the pressure on the collar 4*a*. As a result, the pinion 9 and the collar 4*a* are pushed back again to the original positions as shown in FIGS. 1 and 8 by the force of the compression spring 8. At this time, however, since the notched pinion 9 is contacted at its three points (i.e., the peripheral portion provided with the feed gear 9*a*, and the front and rear feed gears 9*a* and 9*b*) to the peripheral surface of the feed wheel 10 provided with the mesh-prevention side 10*c*, the rotation of the feed wheel 10 caused by rotation of the cylindrical cam shaft 5 does not cause the notched pinion 9 to be rotated. As a result, the switch cam 11 is held in the position able to maintain the ribbon cassette RC in its pushed-up position as shown in FIG. 11. Furthermore, even if an electric power failure occurs when the feed gear 9*a* of the notched pinion 9 is in contact with the notched gear 10*d*, the feed gear 9*a* is prevented from meshing with the notched gear 10*d*, by means of the mesh-prevention side 10*c*. Therefore, even if impacts and/or vibrations are applied to the gears 9*a* and 10*d*, the gears 9*a* and 10*d* are not meshed with each other to rotate the notched pinion 9 accidentally. Thus, a wrong ribbon shifting is not taken place, and a correct color printing is always ensured.

In order to remove the pushed-up condition of the ribbon cassette RC shown in FIG. 11 so as to bring it into the normal color printing condition as shown in FIG. 9, the printer 2 is moved up to the two-color shifting position, indicated by the Y-line of FIG. 1, by the motor M again in accordance with a program, so that the collar 4*a* and the notched pinion 9 are pushed for movement against the compression spring 8 in order to bring the two gears 10*b* and 10*d* of the feed wheel 10 into mesh with the intermittent gear 9*b* and the feed gear 9*a* of the notched pinion 9, respectively, to cause the notched pinion 9 to be intermittently rotated. As a result, the switch cam 11 is rotated in accordance with the same procedure as in the above-mentioned two-color shifting, to lower the ribbon cassette to the horizontal condition as shown in FIG. 9, thus enabling to shift the printing color to the normal color.

As apparent from the foregoing, according to a two-color shifting device for a printing ribbon according to the present invention, when the printing ribbon is to be shifted into the two-color shifting condition, the printer is moved up to the two-color shifting position beyond the normal slide end by the motor in accordance with a program, in order to slide the notched pinion in the axial direction to move the ribbon cassette upwardly and downwardly for acheiving the two-color shifting. Therefore, a solenoid for the exclusive use of two-color shifting is not required. As a result, the whole device can be simplified remarkably, and the manufacturing cost can be reduced. Furthermore, a wrong ribbon shifting is not taken place at any timing, and the printing ribbon can be shifted correctly to a desired printing color, only when it is necessary. Thus, the present invention is very high in practical use when it is applied to a printing part of, for example, a time recorder, etc.

While the present invention has been specifically shown and described herein, the invention itself is not to be restricted to the exact showing of the drawings and the description thereof, and various modifications can be made without departing from the spirit of the invention.

What is claimed is:

1. A two-color shifting device for a printing ribbon, in which when a notched pinion provided with feed gear and intermittent feed gear formed alternately thereon in a circumferential direction thereof is pushed by a printer in order to be moved to a two-color shifting position against a compression spring, a two-piece gear formed on a feed wheel to be rotated by a motor is brought into mesh with said feed gear and intermittent feed gear in turn, respectively, to cause said notched pinion to make a feed-rotation, so that a switch cam formed on said notched pinion switches a ribbon cassette between an upper position and a lower position to effect a two-color shifting, wherein said two-color shifting device for printing ribbon is characterized by:

said feed gear and intermittent gear axially spacedly arranged alternately on the peripheral surface of said notched pinion, a two-piece gear formed of a notched gear meshable with said feed gear and an intermittent gear meshable with said intermittent notched gear being arranged on both front and rear sides of the peripheral surface of said feed wheel, with a mesh-prevention side thinner than a distance between said feed gear and said intermittent feed gear being left at a center thereof, when a normal printing is effected, said feed gear being in contact with said mesh-prevention side to prevent the feed gear from meshing with said notched gear, however, when said notched pinion is moved to said two-color shifting position, said feed gear and intermittent feed gear being brought into mesh with said notched gear and intermittent gear, respectively, so that said notched pinion makes a feed-rotation.

* * * * *